US005906024A

United States Patent [19]

Jailor et al.

[11] Patent Number: 5,906,024

[45] Date of Patent: May 25, 1999

[54] NOZZLE LIFT AND ADJUSTMENT MECHANISM FOR AN UPRIGHT VACUUM CLEANER

[75] Inventors: John J. Jailor, Rockford; Scott R. Graham, Zeeland; William H. Frederick, Grand Rapids; Jeffrey A. Hall, Grand Rapids; Steven K. Meek, Grand Rapids; Eric R. Metzger, Sand Lake, all of Mich.

[73] Assignee: Bissell Inc., Grand Rapids, Mich.

[21] Appl. No.: 08/797,573

[22] Filed: Feb. 7, 1997

Related U.S. Application Data

[60] Provisional application No. 60/011,315, Feb. 8, 1996.

[51] Int. Cl.[6] ..... A47L 5/34

[52] U.S. Cl. ..... 15/354; 15/361

[58] Field of Search ..... 15/354, 361, 333

[56] References Cited

U.S. PATENT DOCUMENTS 3,683,448 8/1972 Lagerstrom et al. .
4,171,554 10/1979 Tschudy .
4,437,205 3/1984 Koland .
4,446,594 5/1984 Watanabe et al. .
4,467,495 8/1984 Fish et al. .
5,222,276 6/1993 Glenn, III .
5,269,042 12/1993 Stephens et al. .
5,551,120 9/1996 Cipolla et al. ..... 15/333

*Primary Examiner*—Chris K. Moore
*Attorney, Agent, or Firm*—Rader, Fishman, Grauer & McGarry

[57] ABSTRACT

The invention disclosed herein relates to an improved vacuum cleaner comprising a foot, a handle pivotally mounted to the foot, and a vacuum motor mounted to one of the handle and the foot. The foot has a suction inlet fluidly connected to the vacuum motor and an agitator brush rotatably mounted to the foot. The improvement relates to a wheel assembly comprising a housing, an axle mounted to the housing and at least one wheel rotatably mounted to the axle. The housing has an integrally-molded flange extending therefrom. The wheel assembly rollably supports the vacuum cleaner on a floor surface. A channel is formed in the foot and is adapted to pivotably mount the housing flange for movement between a first and a second position. In the first position, the wheel assembly supports the suction inlet at a first distance relative to the floor surface. In the second position, the wheel assembly supports the suction inlet at a second distance therefrom.

20 Claims, 4 Drawing Sheets

NOZZLE LIFT AND ADJUSTMENT MECHANISM FOR AN UPRIGHT VACUUM CLEANER

CLAIM OF PRIORITY

This application claims the benefit of U.S. Provisional Application Ser. No. 60/011,315, filed on Feb. 8, 1996.

BACKGROUND OF THE INVENTION

1. Field of the Invention

This invention relates to upright vacuum cleaners and, more specifically, to a nozzle lift mechanism for an upright vacuum cleaner which lifts a nozzle from a ground surface when a handle is pivoted to an upright position and which can be incrementally adjusted to position the nozzle at a preselected height from the ground surface during use.

2. Description of Related Art

Vacuum cleaners come in many styles, including an upright type vacuum cleaner which comprise a foot and a pivotably-mounted elongated handle extending upwardly therefrom. The handle is generally grasped by the user to propel the foot over a surface to be cleaned. The foot is often provided with ground-engaging wheels to provide for easier movement over the surface to be cleaned. The foot typically includes an agitator brush rotatably mounted in a forward portion of the base. The agitator brush is typically mounted adjacent a suction inlet in the foot which receives any dirt and debris loosened by the action of the agitator brush. Suction is applied to the inlet and the dirt and debris are then collected in a bag for later disposal.

Vacuum cleaners are often used to clean both bare floors and carpets having varying thicknesses, pile, and shag characteristics. Thus, it is desirable to provide the vacuum cleaner with a height adjustment mechanism which positions the height of the suction inlet and agitator brush relative to the surface to be cleaned so as to dislodge the greatest amount of dirt and debris therefrom. Examples of prior art height adjustment mechanisms are disclosed in U.S. Pat. Nos. 4,467,495 (Fish et al.), 4,437,205 (Koland), 3,683,448 (Lagerstrom et al.), and 4,171,554 (Tschudy).

Further, it is also desirable to provide a vacuum cleaner with a nozzle lift mechanism which raises the suction inlet and agitator brush from the surface to be cleaned when the handle is pivoted to a non-use position, often generally vertical, to prevent damage to the surface when the agitator brush remains rotating. Examples of prior art nozzle lift mechanisms are disclosed in U.S. Pat. Nos. 3,579,699 (Balzer), 4,782,552 (Bartlett et al.), 5,269,042 (Stephens et al.), 5,255,411 (Da Costa), 4,446,594 (Watanabe et al.) and 5,222,276 (Glenn III).

The height adjustment mechanism and nozzle lift mechanism must typically work in conjunction to prevent either mechanism from prohibiting the other from working properly. For example, the height adjustment mechanism must not lock the suction inlet and agistator brush at a particular height because the handle may be pivoted to the non-use position and actuate the nozzle lift mechanism to raise the suction inlet and agitator brush from the surface to be cleaned. If the height adjustment-mechanism locks the suction inlet and agitator brush at a particular height, damage can occur to either or both of these mechanisms during use.

Prior art nozzle lift mechanisms and height adjustment mechanisms often require several parts and complicated assembly steps to install them in a base of a vacuum cleaner. A large number of parts and additional assembly steps can add to the manufacturing cost of a typical vacuum cleaner.

SUMMARY OF THE INVENTION

In accordance with the present invention, a new and improved height adjustment mechanism for a vacuum cleaner is provided. The present invention contemplates a mechanism which overcomes the limitations of the prior art allowing a user to conveniently adjust the height of a suction inlet and agitator brush relative to a surface and to lift the suction inlet from proximity with the surface only when a handle is pivoted to a non-use position.

In one aspect, the invention relates to an improved vacuum cleaner comprising a foot, a handle pivotally mounted to the foot, and a vacuum motor mounted to one of the handle and the foot. The foot preferably has a suction inlet fluidly connected to the vacuum motor and an agitator brush rotatably mounted to the foot. The improvement in the vacuum cleaner relates to a wheel assembly comprising a housing, an axle mounted to the housing and at least one wheel rotatably mounted to the axle. The housing preferably has an integrally-molded flange extending therefrom. The wheel assembly rollably supports the vacuum cleaner on a floor surface. A channel is preferably formed in the foot and is adapted to pivotably mount the housing flange for movement between a first and a second position. In the first position, the wheel assembly supports the suction inlet at a first distance relative to the floor surface. In the second position, the wheel assembly supports the suction inlet at a second distance relative to the floor surface.

The improved vacuum cleaner can further comprise a height adjustment assembly which, in turn, comprises an actuator movably mounted to the foot and adapted to be actuated between a first setting, a second setting and at least one intermediate setting, and a cam mounted to the actuator so that movement imparted to the actuator is transmitted to the cam. Actuation of the actuator causes the cam to position the wheel assembly a preselected distance from the floor surface.

The cam can be provided with a radial edge which abuts the wheel assembly. The radial edge of the cam preferably is elliptical. The actuator can comprise a wheel rotatably mounted to the foot. The wheel preferably has an outer radial surface which includes several rounded detents thereon. The rounded detents aid a user in grasping the wheel for actuation thereof. The actuator preferably has at least one indentation thereon. A resilient arm can be provided which has a portion thereof mounted to the foot and another portion adapted to engage the at least one indentation on the actuator to selectively retain the actuator at a particular position. A shaft can be provided which has a first end mounted to the actuator and a second end mounted to the cam. Motion imparted to the actuator is preferably transmitted through the shaft to the cam. The second end of the shaft can be eccentrically mounted to the cam.

The vacuum motor of the improved vacuum cleaner disclosed herein is preferably mounted to at least one of the handle and the foot so that the vacuum motor rotates when the handle is pivoted. The vacuum motor preferably has a radially-extending protrusion provided thereon adapted to abut the wheel assembly when the handle is pivoted to a non-use position. The protrusion on the vacuum motor can have generally a right triangular shape. The vacuum motor can also have a second protrusion extending radially therefrom. The second protrusion is adapted to retain the handle in an intermediate position. The second protrusion can be adapted to retain the handle at approximately a 45 degree angle with respect to vertical. The second protrusion permits the vacuum cleaner to clear obstructions such as thresholds or throw rugs by reclining the handle against the second protrusion which allows the front of the vacuum cleaner to be lifted by reclining the handle further.

A portion of the integrally-molded flange on the housing of the wheel assembly can be arcuate. The channel in the foot preferably has an arcuate surface complementary to the arcuate portion of the integrally-molded flange. The arcuate portion can be U-shaped.

In another aspect, the vacuum cleaner according to the invention comprises a foot having a channel, a handle pivotally mounted to the foot, and a vacuum motor mounted to one of the handle and the foot. A suction inlet is provided in the foot and is fluidly connected to the vacuum motor. An agitator brush is rotatably mounted to the foot. A wheel assembly is pivotally mounted to the foot and comprises a housing having an integrally-molded flange received in the channel in the foot, an axle mounted to the housing, and at least one wheel rotatably mounted to the axle wherein the wheel assembly rollably supports the vacuum cleaner on a floor surface. An adjustment mechanism is mounted to the foot and comprises a cam which abuts the wheel assembly and an actuator rotatably mounted to the foot. The actuator is mounted to the cam whereby rotation of the actuator rotates the cam and positions the wheel assembly to a preselected position with respect to the foot. A detent mechanism is mounted to the foot and is adapted to engage one of the actuator and the cam to selectively mount the wheel assembly in one of several incremental positions.

The actuator can comprises a wheel rotatably mounted to the foot. The wheel can also have an outer radial surface which includes several rounded detents thereon. The rounded detents aid a user in grasping the wheel for actuation thereof. The actuator can have at least one indentation thereon and the detent mechanism can comprise a resilient arm mounted to the foot and having a portion adapted to engage within the at least one indentation on the actuator to selectively retain the actuator at a particular incremental position. A shaft is preferably journaled to the foot which has a first end mounted to the actuator and a second end mounted to the cam. Motion imparted to the actuator is preferably transmitted through the shaft to the cam. The second end of the shaft is preferably eccentrically mounted to the cam.

In yet another aspect, the vacuum cleaner according to the invention comprises a foot having a channel, a handle pivotally mounted to the foot, and a vacuum motor rotatably mounted to one of the handle and the foot and having a radially-extending protrusion thereon. A suction inlet is provided on the foot and is fluidly connected to the vacuum motor. An agitator brush is rotatably mounted to the foot. A wheel assembly is pivotally mounted to the foot which comprises a housing having an integrally-molded flange received in the channel in the foot, an axle mounted to the housing, and at least one wheel rotatably mounted to the axle wherein the wheel assembly rollably supports the vacuum cleaner on a floor surface. The vacuum motor is preferably adapted to rotate when the handle is pivoted and the protrusion on the vacuum motor is preferably adapted to abut the wheel assembly when the handle is moved a sufficient extent. When the handle is moved to a non-use position, the protrusion on the vacuum motor abuts the housing and urges the housing downwardly so that the foot is moved to a raised position with respect to a floor surface.

The protrusion on the vacuum motor preferably comprises generally a right triangular shape. The vacuum motor can be provided with a second protrusion extending radially therefrom. The second protrusion is preferably adapted to retain the handle in an intermediate position. The second protrusion is preferably adapted to retain the handle at approximately a 45 degree angle with respect to vertical.

BRIEF DESCRIPTION OF THE DRAWINGS

The invention will now be described with reference to the drawings wherein.

DESCRIPTION OF THE PREFERRED EMBODIMENTS

Figure 1:
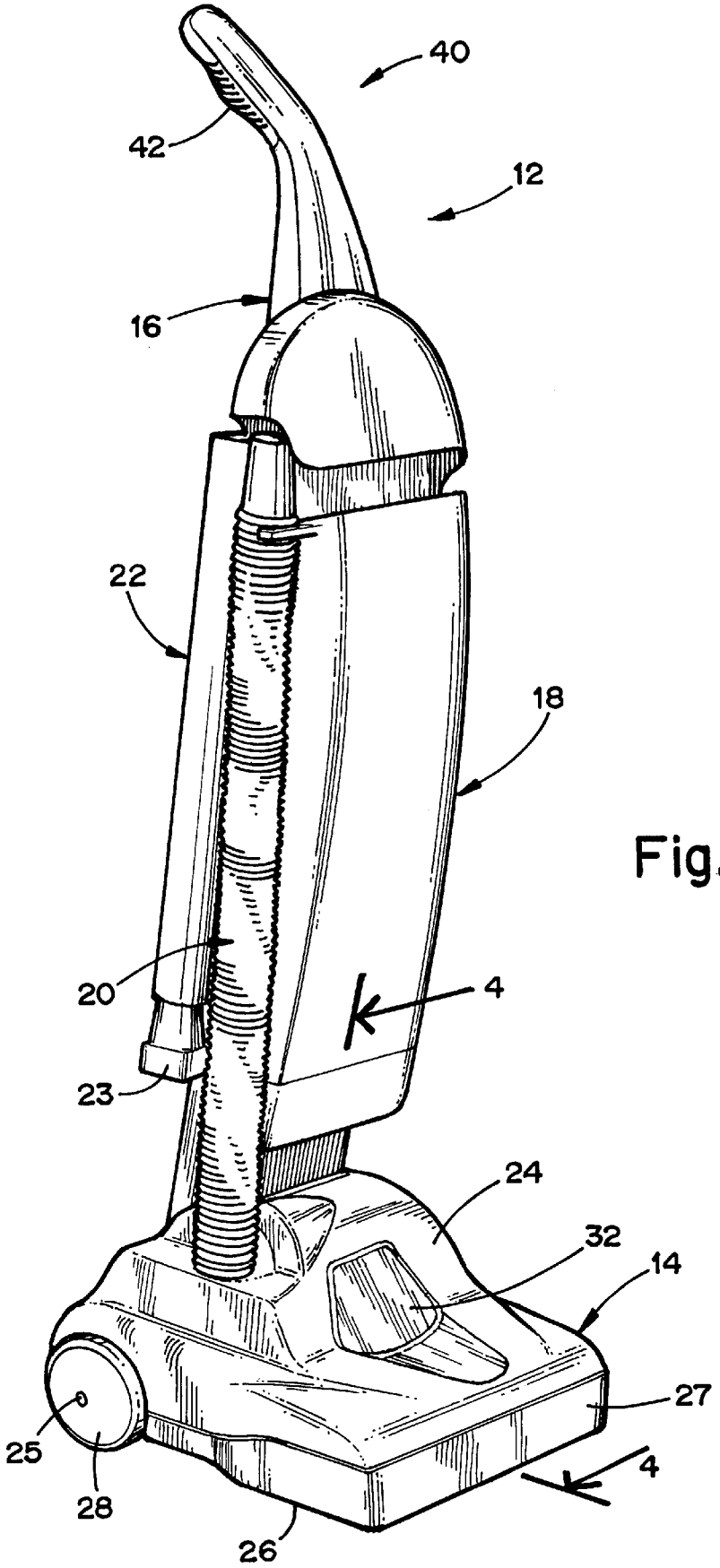
FIG. 1 is a front perspective view of an upright vacuum cleaner according to the invention.
Figure 2:
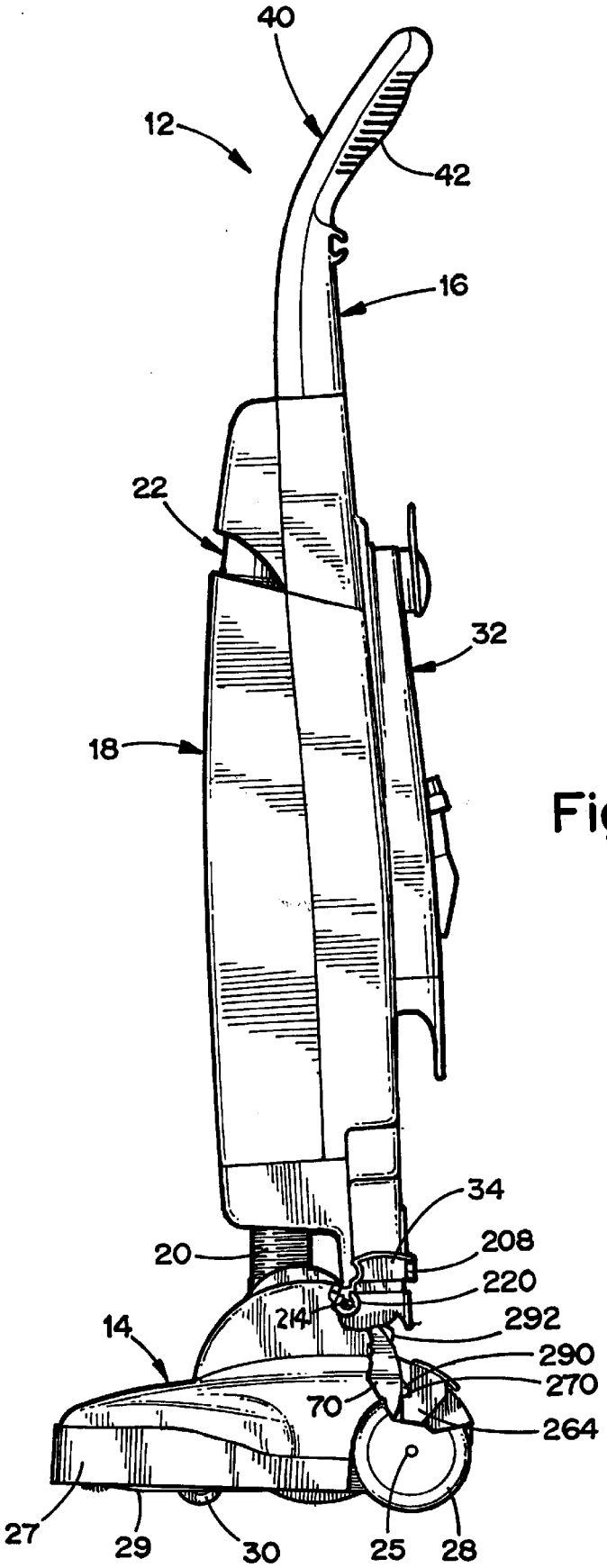
FIG. 2 is a side elevational view of the upright vacuum cleaner of FIG. 1.

Referring now to the drawings and to FIGS. 1–4 in particular, an upright vacuum cleaner 12 according to the invention is shown. The vacuum cleaner 12 comprises a floor engaging foot 14, a handle assembly 16 pivotally mounted to and extending upwardly from the foot 14, a bag housing 18 provided on the handle assembly 16 and a flexible hose 20 extending upwardly from the foot 14.

The foot 14 comprises a cover 24 which is mounted to a base pan 26, a pair of rear wheels 28 supported by pins 25 are provided on the rear of the base pan 26 for rollably supporting the rear of the vacuum cleaner 12. An elastomeric bumper 27 is mounted to a perimetrical surface of the foot 14 by a conventional method. The foot 14 further includes a downwardly-facing suction inlet 75 which includes a rotary agitator brush 68 therein. A pair of lift wheels 30 are provided at a central portion of the base pan 26 are adapted to lift the front of the foot 14 away from the floor when the handle 16 is moved to an upright position. The lift wheels 30 serve the dual purpose of raising the agitator brush 68 thereby preventing damage to the carpet and to provide a mechanism for manually adjusting the operating height of the suction inlet 75 and agitator brush 68.

Figure 3:
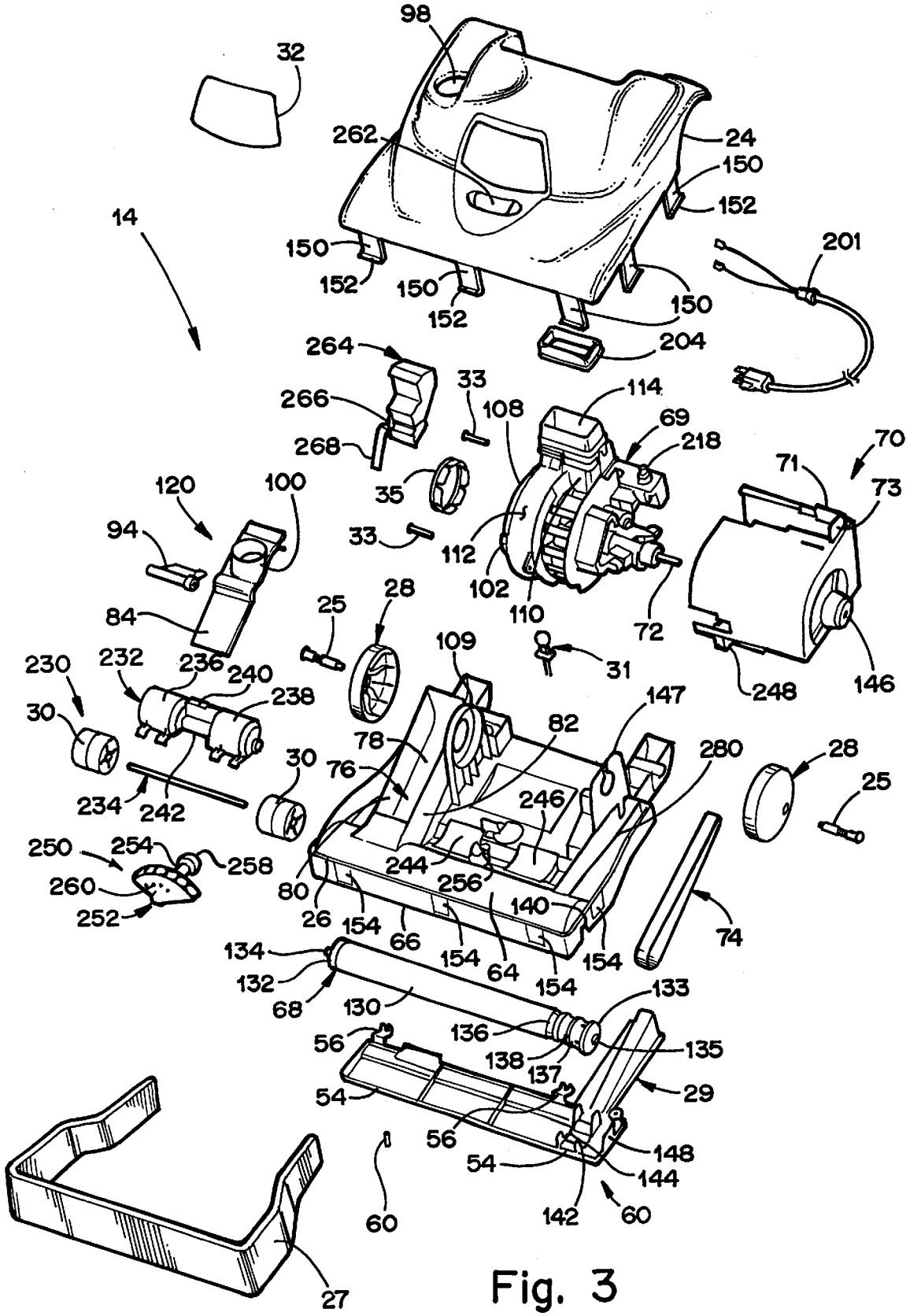
FIG. 3 is an exploded view of a lower portion of the upright vacuum cleaner of FIG. 1.
Figure 4:
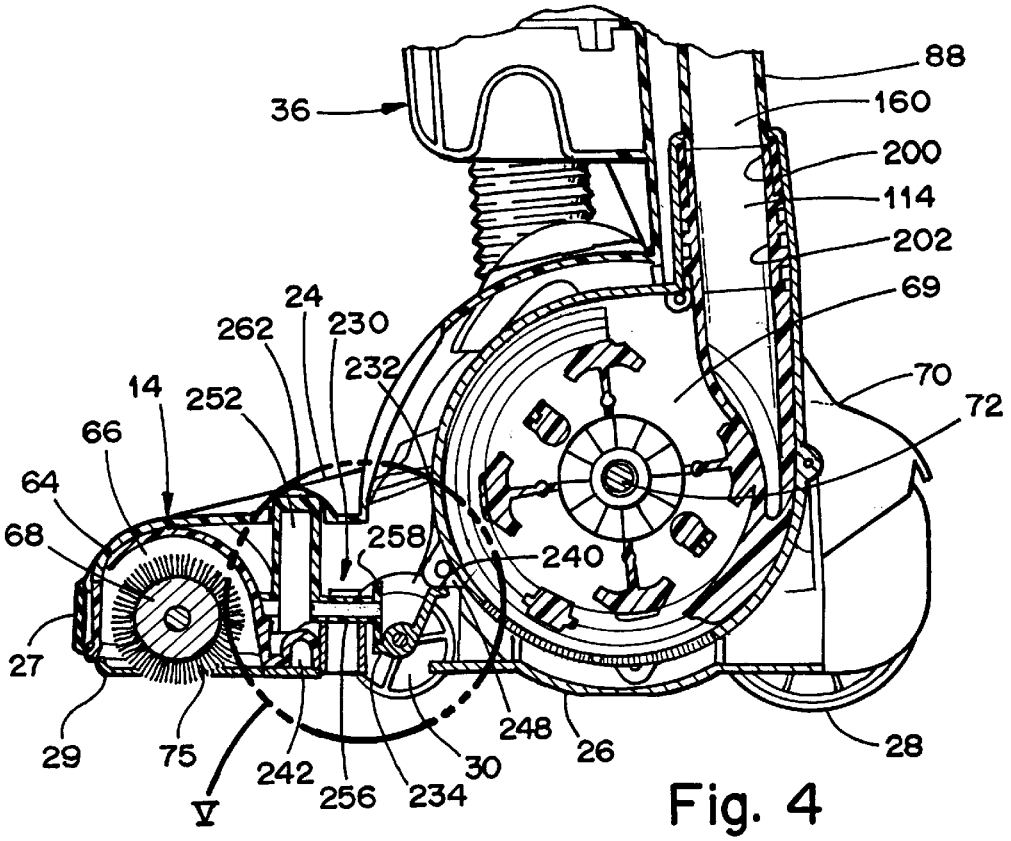
FIG. 4 is a fragmentary cross-sectional view of the upright vacuum cleaner of FIG. 1, taken along lines 4—4 of FIG. 1.

Referring now to FIGS. 3 and 4, a vacuum motor 69 is provided inside a vacuum motor housing 70 which is rotatably mounted to the base pan 26. An upper surface of the vacuum motor housing 70 includes a pair of upwardly-extending rectangular flanges 71 and 73 disposed at a right angle with respect to each other and located adjacent a vacuum motor power toggle switch 218. A circular boss 108 extends from an impeller end 102 of the vacuum motor housing 70 and a second circular boss 146 extends from the other end of the vacuum motor housing 70. The boss 108 is inserted within an upwardly-extending circular retainer bracket 109 on the base pan 26 and the boss 146 is then urged downwardly and an end portion of the boss 146 is snapped into a slotted circular retainer bracket 147 extending upwardly from base pan 26. An inner portion of the boss 146, the circular bosses 108, 146 and retention brackets 109, 147 cooperate to pivotally secure the motor housing 70 to the base pan 26 as more fully disclosed in U.S. Patent application Ser. No. 08/421,402 entitled Motor Mounting Arrangement and Method for a Vacuum Cleaner, filed Apr. 13, 1995, now U.S. Pat. No. 5,511,282 issued Apr. 30, 1996, which is incorporated herein by reference. A downward-facing rib (not shown) on the cover 24 is positioned outwardly of the retainer bracket 147 to prevent the vacuum motor 69 from coming out of engagement with the retainer bracket 147 when the cover 24 is assembled onto the base pan 26.

As shown in FIGS. 3 and 4, an intermediate wall 64 of the base pan 26 forms a agitator chamber 66 in which the agitator brush 68 is rotatably mounted. The suction inlet 75 is provided in the agitator chamber 66 for conventional on-the-floor cleaning. The agitator brush 68 comprises a cylindrical body 130 having first and second bearings 132 and 133, respectively, at each end. Each bearing 132 and 133 includes an axially-extending projection 134 and 135, respectively. The cylindrical body 130 includes first and second axially-spaced transverse grooves 136 and 137 adjacent the second bearing 133 and has a crowned belt-receiving portion 138 between the grooves 136, 137. To assemble the agitator brush 68 into the foot 14, a motor shaft 72 of the vacuum motor 69 extends from one end of the housing 70 and receives a drive belt 74. The belt 74 extends forwardly to capture the belt-receiving flange 138 of the agitator brush 68 to rotatably drive the agitator brush 68. The base pan 26 includes a first socket (not shown) into which the projection 134 on the bearing 132 is inserted. The projection 135 on the second bearing 133 is inserted into a vertical slot 140 in the base pan 26 and is retained therein by the bearing 148 on the sole plate 29 when the sole plate 29 is mounted to the base pan 26. The sole plate 29 has flanges 142 and 144 which are semi-circular in configuration and form annular baffles therein. Similar semi-circular flanges are located on the base pan 26 in complementary relationship to the flanges 142 and 144. When the sole plate 29 is mounted to the base pan 26, the flanges 142 and 144 form annular baffles which are positioned in the first and second grooves 136 and 137 to prevent debris from entering the belt-receiving area 138. Preferably, the vacuum motor housing 70 and base pan 26 are designed such that the vacuum motor housing 70 rotates about the axis of rotation of the shaft 72 and the bosses 108, 146 are concentrically aligned with the axis of the shaft 72.

An impeller fan 110 is operably coupled to the motor 69 and is in the impeller end 102 of housing 70. The impeller fan 110 is received in a conventional volute chamber 112 of the vacuum motor housing 70. The volute chamber 112 terminates in an outlet conduit 114 which is integrally formed with the vacuum motor housing 70 and extends outwardly therefrom. A resilient motor output gasket 204 is fitted over the outlet conduit 114. The output gasket 204 is snugly inserted over the outlet conduit 114 and is further matingly received within an inlet tube 160 of the handle assembly 16 in order to provide a sealed fit between the outlet conduit 114 of the vacuum motor housing 70 and the handle assembly 16. The outlet conduit 114 of the vacuum motor housing 70 is then securely mounted to the base portion of the handle assembly 16 by a conventional fastener 208 to permit the handle assembly 16 to rotate with the motor housing 70, with respect to the base pan 26 about the axis of rotation of the motor shaft 72.

A working air conduit 76 is formed in the base pan 26 by a bottom wall 78 and a pair of upstanding side walls 80 and 82. The conduit 76 is closed on the top by a cover plate 84 which mounts a diverter valve 94. The diverter valve 94 is sealed to the side walls 80 and 82 and the bottom wall 78 by a shoulder (not shown) which is in contact with the side walls 80 and 82 during movement of the handle assembly 16 between an upright position and a reclining position. The working air conduit 76 extends rearwardly from one end of the agitator chamber 66 to the impeller fan opening 110 thereby fluidly connecting the agitator chamber 66 and the impeller fan 110. A flexible hose mount 100 is integrally formed in the cover plate 82 and mounts the lower end of the flexible hose 20. The hose mount 100 is in registry with hose opening 98 in cover 24. Conventional fasteners such as adhesives can be used to secure the lower end of the hose 20 to the mount 100.

As shown in FIG. 3, the convertible upright vacuum cleaner 12 according to the invention incorporates a conversion valve assembly 120, described in U.S. Pat. No. 5,560,074 issued Oct. 1, 1996 and incorporated herein by reference, to selectively direct the suction generated by the impeller fan between either the agitator chamber 66 or the flexible hose 20 depending upon the position of the handle 16 relative to the foot 14. The diverter valve 94 is controlled by the handle 16 to shut off the flow of air from the brush roll chamber 68 or the flexible hose in a manner described in U.S. Pat. No. 5,560,074. With the handle 16 received in the upright position as seen in FIG. 1, the diverter valve assembly 94 is pivoted to establish fluid flow communication between the flexible hose 20 and the volute chamber 112 and block fluid flow communication between the agitator chamber 66 and the volute chamber 112. Therefore, all of the suction generated by the rotation of the impeller fan 110 is directed solely to the flexible hose 20 for above-the-floor cleaning when the handle assembly 16 is in the upright position as shown in FIG. 1.

According to the invention, the upright vacuum cleaner 12 also includes a lift assembly 230 which automatically lifts the agitator chamber 66 from contact with the floor being cleaned when the handle assembly 16 is pivoted from a rearwardly tilted use position to the upright storage position shown in FIG. 1.

Figure 5:
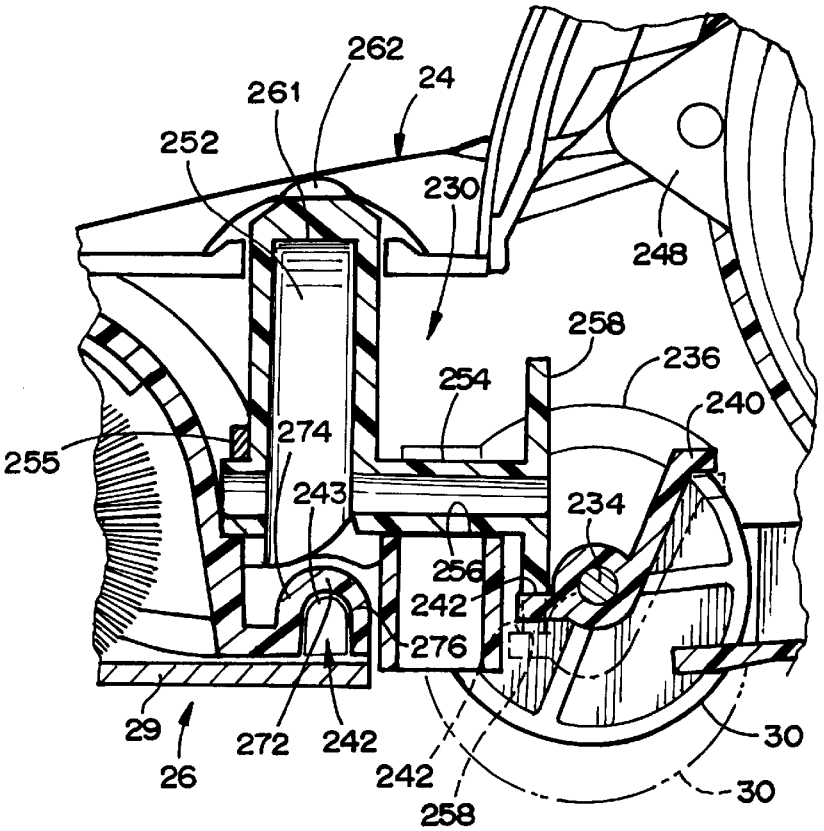
FIG. 5 shows cross-sectional view of the vacuum cleaner of FIG. 1, enlarging the encircled region marked V of FIG. 4.

Turning to FIGS. 3–5, the lift assembly 230 comprises a housing 232, axle 234 and lift wheels 30. The housing 232 comprises a pair of semi-cylindrical shells 236 and 238 connected at a central portion by a flange 240. The housing 232 includes two pairs of forwardly-extending flanges 242 each having a transversely-oriented cylindrical retainer bracket 243 extending upwardly therefrom. The base pan 26 includes two pairs of inverted U-shaped mounts 272 extending upwardly from the base pan 26 adjacent the agitator chamber 66 and mounted to the base pan 26 at a forward leg 274 and a rearward leg 276. The housing 232 is assembled to the base pan 26 by positioning the housing 232 in a vertical orientation adjacent the U-shaped mounts 272. The housing 232 is then slid transversely in order to slidably insert the bracket 243 of the flanges 242 into the interior of the U-shaped mounts 272 for pivotable movement of the housing 232 in the U-shaped mounts 272. Axle 234 is mounted to the housing 232 and rotatably mounts the lift wheels 30, each of which is disposed within a shell 236 and 238 such that the housing 232 can pivot the attached lift wheels 30 downwardly through corresponding apertures 244 and 246 provided in a central portion of the base pan 26.

The pivotably-mounted motor housing 70 includes an outwardly-extending triangular protrusion 248 along its forward surface. As the vacuum cleaner handle assembly 16 is rotated from a rearwardly tilted position to an upright position as shown in FIG. 1, the outwardly-extending protrusion 248 on the surface of the rotating motor housing 70 contacts the wheel housing 232 at central flange 240 and forces the wheel housing 70 to pivot downwardly with respect to the base pan 26 to thereby raise the forward end of the foot 14 with respect to the floor surface. The raising of foot 14 lifts the agitator brush 68 from contact with the floor surface.

Again turning to FIGS. 3–5, the upright vacuum cleaner 12 also includes a manual height adjustment mechanism 250 comprising a thumb wheel 252 mounted at a central portion thereof to a forward end of a shaft 254 which is journaled at 256 in the base pan 26 and includes a smooth, elliptical eccentrically-mounted cam 258 at a rearward end of the shaft 254. The thumb wheel 252 comprises a substantially semi-cylindrical shell having several detents 260 on a forward surface and several rounded detents on an outward radial surface 261 thereof. The journal mounting 256 comprises a upwardly-extending slotted circular retainer. A central portion of the shaft 254 snap-fits within the journal mounting 256 which supports the shaft 254 for rotation about a longitudinal axis of the shaft 254. Alternatively, or in addition to the journal mounting 256, the forward end of the shaft 254 can be cantilevered within a circular socket 255 within the base pan 26 to provide additional rotational support for the shaft 254. At the opposite end of the shaft 254, the cam 258 bears against the central flange 240 of the wheel housing 232. The detents 260 along the outer forward surface of the thumb wheel 252 mate with a resilient deflectable finger (not shown) mounted to the base pan 26 to hold the thumb wheel 252 in one of several adjustment positions. In its assembled state within the base pan 26, the rounded detents on the outer radial surface of the thumb wheel 252 protrude through an aperture 262 on the cover 24 for access to the height adjustment mechanism 250 by the user. Although the thumb wheel 252 can be rotated while the handle assembly 16 is in the upright position, actual pivotable movement of the wheel housing can only occur when the handle assembly 16 is lowered into a rearwardly tilted use position. As shown in FIG. 5, when the handle assembly is lowered into an angular use position, the triangular protrusion 248 on the motor housing 70 is rotated upwardly above the housing 232. The weight of the vacuum cleaner rests in part on the lift wheels 30 urging them upwardly against the lower edge of the cam 258. As the height adjustment wheel 252 is rotated by the operator, the eccentric mounting of the cam 258 on the thumb wheel 252 moves the lower edge of the cam 258 vertically with respect to the base pan 26 which, in turn, urges the housing 232 upwardly or downwardly as shown in the phantom outline of FIG. 5. In addition, the rotation of the thumb wheel 252 positions the deflectable finger (not shown) at the next successive detent 260 on the forward surface of the thumb wheel 252 to retain the lift wheels 30 at the new height.

The upright or lowered position of the handle assembly 16 is controlled by a foot pedal 264 which locks the handle assembly 16 in an upright position, releases the handle, assembly 16 for movement to a 45-degree position, and then further releases the handle assembly 16 to permit rotation of the handle to an essentially horizontal position. The foot pedal 264 is pivotably mounted to the base pan 26 of the vacuum cleaner 12 by an elliptical axle 266 similar to pivot mounts 214 and is adapted to be received by a slotted circular retainer (not shown) similar to C-shaped sockets 220 on the base pan 26. Foot pedal 264 includes an integral arm spring 268 mounted adjacent to an exterior side of the foot pedal 264 to bias the foot pedal 264 in an upright position. The motor housing 70, attached to the handle assembly 16 and rotatably mounted to the base pan 26, has first and second triangular protrusions 290 and 292 circumferentially disposed in a spaced relationship along a lateral radial portion of the motor housing 70 and which can register with a ridge 270 on the foot pedal 264. The first protrusion 290 is a "hard" detent comprising a substantially right triangular flange extending from a rearward portion of the motor housing 70 adjacent the impeller end 102 as shown in the cut-out portion of FIG. 2. The second protrusion 292 is a "soft" detent comprising a gently-sloped substantially isosceles triangular flange spaced circumferentially upward from the first protrusion 290. The first protrusion 290 retains the handle assembly 16 in a substantially vertical position, preferably about 5 degrees forward of vertical, and requires actuation of the foot pedal 264 to release the handle assembly 16 for rotation. The second protrusion 292 retains the handle assembly at approximately 45 degrees rearward of vertical and requires either actuation of the foot pedal 264 or slight manual downward pressure exerted on the nozzle 14 to release the handle assembly 16 for further downward rotation to a horizontal position. When the handle assembly 16 is to be rotated, foot pedal 264 is momentarily depressed which rotates it away from the motor housing 70 to release the ridge 270 on the foot pedal 264 from contact with the first protrusion 290 on the motor housing 70 to allow the handle assembly to freely rotate to a position defined by the second protrusion 292. The position of the protrusions 290 and 292 on the motor housing 70 are selected such that the handle position has three defined locations: a fully upright position approximately 5 degrees in front of vertical, an approximate 45-degree position used normally during operation of the vacuum and to lift the vacuum over a small obstruction and a substantially horizontal position for vacuuming under tables and the like. When the foot pedal 264 is released, the arm spring 268 urges the ridge 270 back into contact with the motor housing 70.

In operation, the handle assembly 16 on the upright vacuum cleaner 12 can be placed into a floor cleaning use position by actuating foot pedal 264 and lowering the handle assembly 16 into an approximate 45-degree position or any position intermediate the vertical and 45-degree position. The vacuum motor 69 can be actuated by momentarily depressing foot switch 34 activating the vacuum motor 69 so that the vacuum cleaner 12 can be rolled over the floor surface to be cleaned. Depending upon the type of floor surface being cleaned, the thumb wheel 252 of the height adjustment mechanism 250 can be rotated clockwise or counterclockwise to raise or lower the housing 232 and, consequently, the agitator brush 68 and suction inlet 75 are repositioned at a particular desired height for optimal cleaning effectiveness. Once the foot switch 34 is actuated which supplies power to the motor 69, the agitator brush 68 is rotated at a high speed through the transmission of the rotation of the motor shaft 72 through the belt 74. Dust and other debris is loosened by the agitator brush 68 and suctioned into the working air conduit 76, expelled out of the outlet conduit 114, and into the vertical conduit in the handle assembly 16 such that it is trapped in a filter bag therein. Alternatively, the hose 20 can be used to collect dust and debris when the handle assembly 16 is in the upright position as the conversion valve assembly 120 diverts the suction through the hose 20. When finished, the handle assembly 16 can be repositioned in the upright position as shown in FIG. 1 which automatically lifts the foot 14 from contact with the floor via lift mechanism 230 and turned off by again momentarily depressing foot switch 34.

On occasion, the vacuum motor drive belt 74 wears thin and requires replacement. When it is desired to replace the belt 74, the sole plate 29 can be removed, which exposes an axially-extending channel 280 in the base pan 26 into which extends the motor shaft 72 and the forwardly-extending drive belt 74. The sole plate 29 can be removed by manually disengaging each flexible finger 56 from engagement with tabs on the base pan 26. The agitator brush 68 is rotatably mounted within an agitator chamber 66 provided in the base pan 26 and is retained at one end by a circular aperture in the base and at another end by a bearing projection on the sole plate 29. The sole plate 29 has a flexible finger 56 with a retainer which snaps into an opening in the base pan 26. The belt 74 passes around the shaft 72 of the motor 69 and around a groove on the agitator brush 68 such that rotation of the shaft 72 causes the belt 74 to impart rotary motion to the agitator brush 68. The removal of the sole plate 29 from the base pan 26 reveals the wide channel 280 along the longitudinal path of the vacuum motor drive belt 74 so that the channel 280 provides easy access for removal and replacement of the drive belt 74. To replace the belt 74, the agitator brush 68 is removed from the agitator chamber 66 in the base pan 26 and a new belt can be slipped over the shaft 72 in the channel 280 and over a belt-receiving area 138 of the agitator brush 68. The agitator brush 68 can then be moved forward into the agitator chamber 66 in the base pan 26 which stretches the belt 74 as it moves and provides the proper tension in the belt. The sole plate 29 is then remounted on the base pan 26 to retain the agitator brush 68 and permit the rearwardly-extending flange on the sole plate 29 to re-cover the belt 74 in the channel 280.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. An improved vacuum cleaner comprising a foot, a handle pivotally mounted to the foot, a vacuum motor mounted to one of the handle and the foot, the foot having a suction inlet fluidly connected to the vacuum motor, and an agitator brush rotatably mounted to the foot, the improvement comprising:

(1) a wheel assembly comprising a housing, an axle mounted to the housing and at least one wheel rotatably mounted to the axle, the housing having a plurality of integrally-molded flanges extending therefrom, each flange having a bracket at an outer end thereof, each bracket being a cylindrical member, wherein the wheel assembly is adapted to rollably support the vacuum cleaner on a floor surface;

(2) a plurality of inverted U-shaped members formed in the foot wherein each U-shaped member defines an interior portion, and wherein each bracket is received within the interior portion of a corresponding U-shaped member to pivotally mount the housing with respect to the foot;

(3) a height adjustment mechanism mounted to the foot in abutment with the wheel housing adapted to retain the wheel housing in a first and a second position relative to the foot;

whereby, when the height adjustment mechanism is located in the first position, the wheel assembly supports the suction inlet at a first distance relative to the floor surface and, when the height adjustment mechanism is located in the second position, the wheel assembly supports the suction inlet at a second distance relative to the floor surface.

2. The improved vacuum cleaner of claim 1 wherein the height adjustment assembly comprises:

(1) an actuator movably mounted to the foot and adapted to be actuated between a first setting, a second setting and at least one intermediate setting; and (2) a cam mounted to the actuator and in abutment with the wheel assembly so that movement imparted to the actuator is transmitted to the wheel assembly via the cam;

whereby actuation of the actuator causes the cam to position the wheel assembly a preselected distance from the floor surface.

3. The improved vacuum cleaner of claim 2 wherein the cam has a radial edge which abuts the wheel assembly.

4. The vacuum cleaner of claim 2 wherein the actuator comprises a sector-shape member rotatably mounted to the foot.

5. The vacuum cleaner of claim 4 wherein the actuator has an outer radial surface which includes several shallow indentations thereon whereby the indentations aid a user in grasping the actuator for actuation thereof.

6. The improved vacuum cleaner of claim 2 wherein the actuator has at least one indentation thereon.

7. The improved vacuum cleaner of claim 2 wherein the height adjustment assembly further comprises a shaft having a first end mounted to the actuator and a second end mounted to the cam whereby motion imparted to the actuator is transmitted through the shaft to the cam.

8. The improved vacuum cleaner of claim 1 wherein the vacuum motor is mounted to at least one of the handle and the foot so that the vacuum motor rotates when the handle is pivoted.

9. The improved vacuum cleaner of claim 8 wherein the vacuum motor further comprises a vacuum motor housing, the vacuum motor housing has a radially-extending first protrusion provided thereon adapted to abut the wheel assembly when the handle is pivoted to a non-use position.

10. The vacuum cleaner of claim 9 wherein the first protrusion on the vacuum motor housing comprises generally a right triangular shape.

11. The vacuum cleaner of claim 10 wherein the vacuum motor housing has a second protrusion extending radially therefrom whereby the second protrusion is adapted to retain the handle in an intermediate position.

12. The vacuum cleaner of claim 11 wherein the second protrusion is adapted to retain the handle at approximately a 45 degree angle with respect to vertical.

13. A vacuum cleaner comprising:

(a) a foot having a plurality of U-shaped members formed therein, each U-shaped member having an interior portion;

(b) a handle pivotally mounted to the foot;

(c) a vacuum motor mounted to one of the handle and the foot;

(d) a suction inlet provided in the foot and fluidly connected to the vacuum motor;

(e) an agitator brush rotatably mounted to the foot;

(f) a wheel assembly pivotally mounted to the foot comprising:

(i) a housing having a plurality of integrally-molded flanges, each flange having a cylindrical bracket at an outer end thereof which is received in a corresponding interior portion of a corresponding U-shaped member in the foot;

(ii) an axle mounted to the housing; and (iii) at least one wheel rotatably mounted to the axle wherein the wheel assembly rollably supports the vacuum cleaner on a floor surface; and (g) an adjustment mechanism mounted to the foot and comprising a cam abutting the wheel assembly and an actuator rotatably mounted to the foot, the actuator being mounted to the cam whereby rotation of the actuator rotates the cam and positions the wheel assembly to preselected discrete positions with respect to the foot.

14. The vacuum cleaner of claim 13 wherein the actuator comprises a sector-shaped member rotatably mounted to the foot.

15. The vacuum cleaner of claim 14 wherein the sector-shaped member has an outer radial surface which includes several shallow indentations thereon whereby the indentations aid a user in grasping the wheel for actuation thereof.

16. The vacuum cleaner of claim 13 further comprising a shaft journaled to the foot and having a first end mounted to the actuator and a second end mounted to the cam whereby motion imparted to the actuator is transmitted through the shaft to the cam.

17. A vacuum cleaner comprising:

(a) a foot having a plurality of U-shaped members formed therein, each U-shaped member having an interior portion;

(b) a handle pivotally mounted to the foot;

(c) a vacuum motor housing rotatably mounted to one of the handle and the foot and having a radially-extending protrusion thereon;

(d) a suction inlet provided on the foot and fluidly connected to the vacuum motor;

(e) an agitator brush rotatably mounted to the foot;

(f) a wheel assembly pivotally mounted to the foot comprising:

(i) a housing having a plurality of integrally-molded flanges, each flange having a cylindrical bracket at an outer end thereof which is received in a corresponding interior portion of a corresponding U-shaped member in the foot;

(ii) an axle mounted to the housing; and (iii) at least one wheel rotatably mounted to the axle wherein the wheel assembly rollably supports the vacuum cleaner on a floor surface;

(g) the vacuum motor adapted to rotate when the handle is pivoted and the protrusion on the vacuum motor being adapted to abut the wheel assembly when the handle is moved to a storage position;

whereby when the handle is moved to the storage position, the protrusion on the vacuum motor abuts the housing and urges the housing downwardly so that the foot is moved to a raised position with respect to a floor surface.

18. The vacuum cleaner of claim 17 wherein the protrusion on the vacuum motor housing comprises generally a right triangular shape.

19. The vacuum cleaner of claim 18 wherein the vacuum motor housing has a second protrusion extending radially therefrom whereby the second protrusion is adapted to retain the handle in an intermediate position.

20. The vacuum cleaner of claim 19 wherein the second protrusion is adapted to retain the handle at approximately a 45 degree angle with respect to vertical.

* * * * *